United States Patent [19]

Röck et al.

[11] Patent Number: 4,937,917

[45] Date of Patent: Jul. 3, 1990

[54] HINGE

[75] Inventors: Erich Röck, Höchst; Helmut Rupprechter; Klaus Brüstle, both of Lauterach, all of Austria

[73] Assignee: Julius Blum Gesellschaft m.b.H., Höchst, Austria

[21] Appl. No.: 231,213

[22] Filed: Aug. 11, 1988

[30] Foreign Application Priority Data

Aug. 18, 1987 [AT] Austria ..... A 2068/87

[51] Int. Cl.[5] ..... E05D 7/04; E05D 7/12

[52] U.S. Cl. ..... 16/245; 16/259; 16/264; 16/267; 16/270; 16/272; 16/364; 16/DIG. 43

[58] Field of Search ..... 16/366, 257, 258, 259, 16/261, 260, 267, 264, 270, 272, 382, DIG. 43, 235, 245, 246, 249, 346, 349–353, 364, 242, 364; 49/398, 399, 400; 403/406.1

[56] References Cited

U.S. PATENT DOCUMENTS

| | | | |
|---|---|---|---|
| 2,497,337 | 2/1950 | Ackerman | 16/259 |
| 2,749,569 | 6/1956 | Sandberg | 16/258 |
| 2,974,354 | 3/1961 | Matuzas | 16/258 |
| 3,205,531 | 9/1965 | Amos | 16/258 |
| 3,909,879 | 10/1975 | Grunert | 16/245 |
| 4,099,293 | 7/1989 | Pittasch | 16/245 |
| 4,134,180 | 1/1979 | Schneider et al. | 16/245 |
| 4,177,540 | 12/1979 | Gorton | 49/398 |
| 4,293,976 | 10/1981 | Pittasch et al. | 16/245 |
| 4,368,558 | 1/1983 | Grass | 16/245 |
| 4,493,129 | 1/1985 | Grass | 16/246 |
| 4,506,409 | 3/1985 | Lautenschlager | 16/245 |
| 4,583,261 | 4/1986 | Rock et al. | 16/257 |
| 4,604,769 | 8/1986 | Rock et al. | 16/245 |
| 4,799,290 | 1/1989 | Lautenschlager, Jr. | 16/258 |
| 4,819,298 | 4/1989 | Lautenschlager | 16/237 |

FOREIGN PATENT DOCUMENTS

| | | | |
|---|---|---|---|
| 2439252 | 3/1976 | Fed. Rep. of Germany | 16/353 |
| 2721951 | 11/1978 | Fed. Rep. of Germany | 16/245 |
| 3004313 | 8/1981 | Fed. Rep. of Germany | 16/245 |
| 252410 | 12/1987 | Fed. Rep. of Germany | 16/245 |
| 1479078 | 4/1967 | France | 16/353 |
| 2183722 | 6/1987 | United Kingdom | 16/260 |

*Primary Examiner*—Nicholas P. Godici
*Assistant Examiner*—Edward Brown
*Attorney, Agent, or Firm*—Wenderoth, Lind & Ponack

[57] ABSTRACT

A hinge, in particular a one-axle hinge, includes a hinge arm mountable to a furniture wall and at least one hinge casing which is on the side of a door. The hinge casing is linked to the hinge arm and an inner coupling member insertable therein. A clamping screw holds the coupling member. The coupling member is lockable in the hinge casing by a locking member which is a spring or has spring acting parts or which is acted upon by a spring.

48 Claims, 16 Drawing Sheets

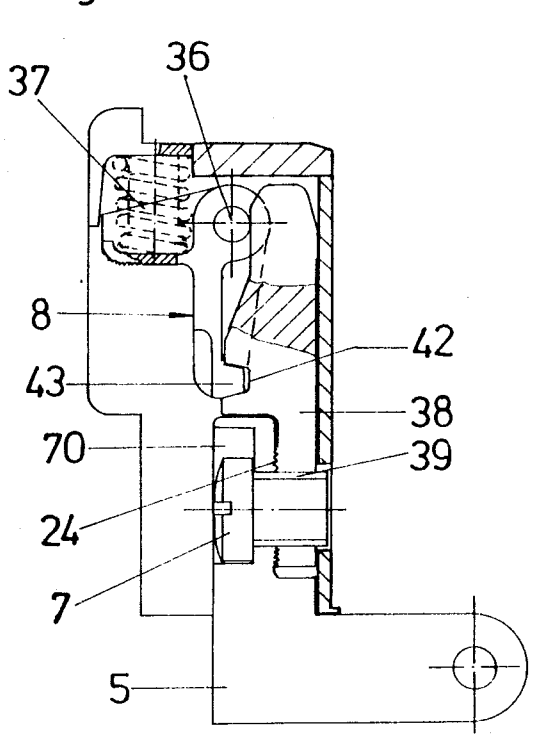
Fig. 15
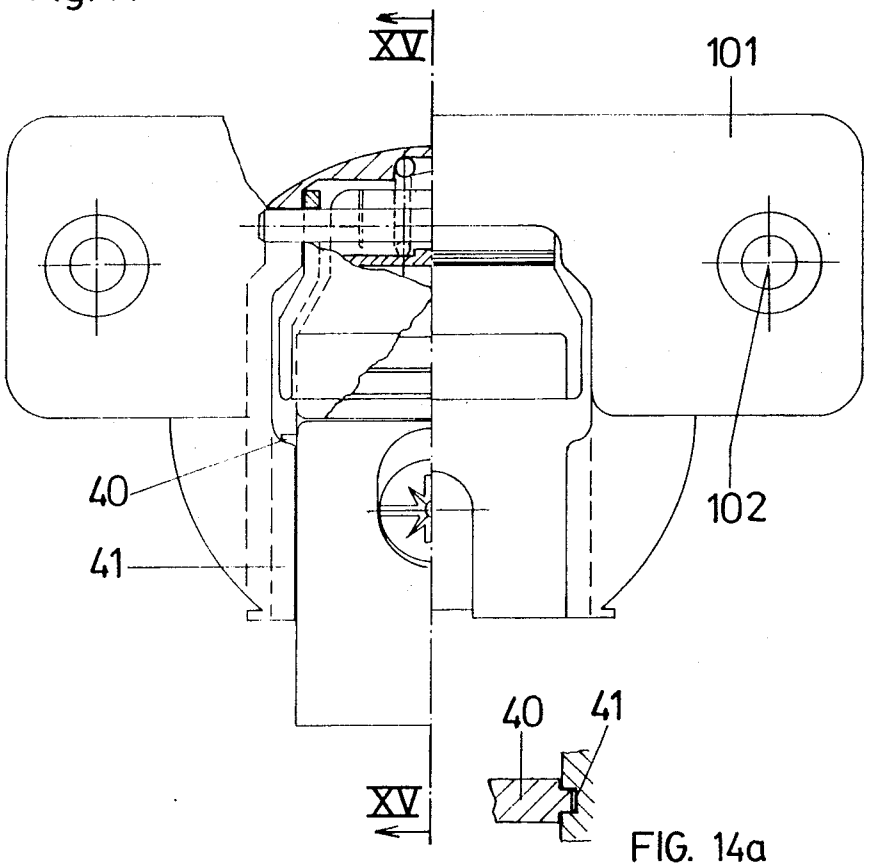
Fig. 14
FIG. 14a

HINGE

FIELD AND BACKGROUND OF THE INVENTION

The invention relates to a hinge, in particular a one-axle hinge, including a hinge arm mountable on a furniture wall, at least one hinge casing which is on the side of a furniture door, such hinge casing being linked to the hinge arm, an inner coupling member being insertable into the hinge casing and releasably lockable thereto, and a clamping screw.

Hinges of the above-mentioned kind are particularly used in the construction of furniture designed for offices and industrial structures. They are used as corner and twin hinges, i.e. hinges to which two doors are linked.

In general, they are manufactured as one-axle hinges.

In conventional hinges, a mounting plate is fastened to the furniture side wall when the piece of furniture is assembled. A hinge casing is inserted into the door, and is connected with the actual hinge arm by means of a hinge assembly of four hinge axles and two hinge links. In the final mounting operation, the hinge arm mounted on the door is positioned on the mounting plate mounted on the side wall and connected thereto. By relatively displacing the position of the hinge arm to the mounting plate, the position of the door can be adjusted. In general, conventional hinges provide the possibility of adjustment in the direction of the breadth of the joint of the furniture door and in the direction of the depth of the article of furniture. In some cases, a vertical adjustment also is possible.

Hinges of the kind mentioned at the outset differ from the afore-mentioned hinges in that the hinge arm is fastened directly to the furniture side wall, for example screwed thereto. This has the advantage that the hinge arm may have a very narrow design, and additional space can be saved, since an additional mounting plate is not required. The full breadth of the article of furniture can be used in an optimal manner, for example as desired in filing cabinets or the like.

Two-part mounting is also known with these hinges, which means that the hinge arm is fastened to the furniture side wall and a hinge casing is inserted into the door. When the door is finally mounted, the hinge casing is linked to the hinge arm by means of a coupling member which is linked to the hinge arm. In conventional hinges, this is done by means of a clamping screw.

SUMMARY OF THE INVENTION

It is the object of the invention to improve a hinge of the kind described in the introduction to this specification wherein the mounting of the door, i.e. connecting the hinge casing with the coupling member, is facilitated. Such mounting in particular should be possible without a tool, since fastening of the clamping screw often causes difficulties when the door must be held or supported. It should nevertheless be easily possible to disengage the door, i.e. to separate the hinge casing from the hinge arm.

This object is, according to the invention, solved in that the coupling member is lockable in the hinge casing by means of a locking member which is a spring, or which has spring acting parts, or which is acted upon by a spring.

The locking member advantageously is held at the coupling member by means of the clamping screw.

BRIEF DESCRIPTION OF THE DRAWINGS

In the following various embodiments of the invention will be described in more detail with reference to the accompanying drawings, in which:

FIG. 14 is a top view of a further embodiment of a hinge casing, parts thereof being shown in section;

Figure 16:
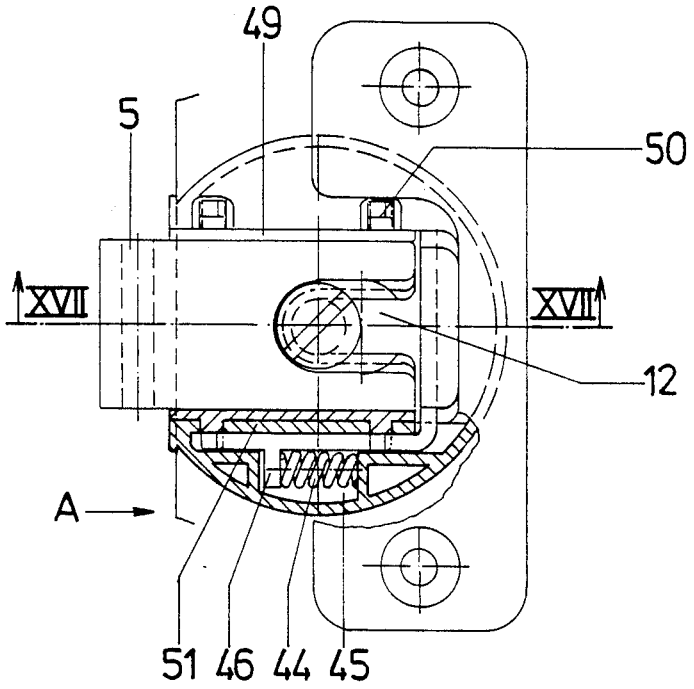
Figure 17:
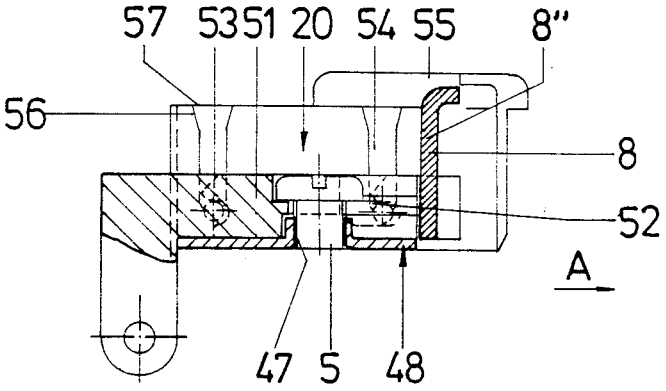
Figure 19:
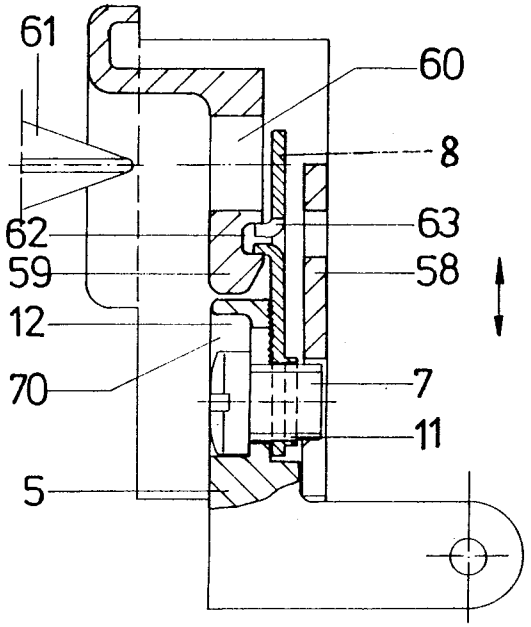
Figure 18:
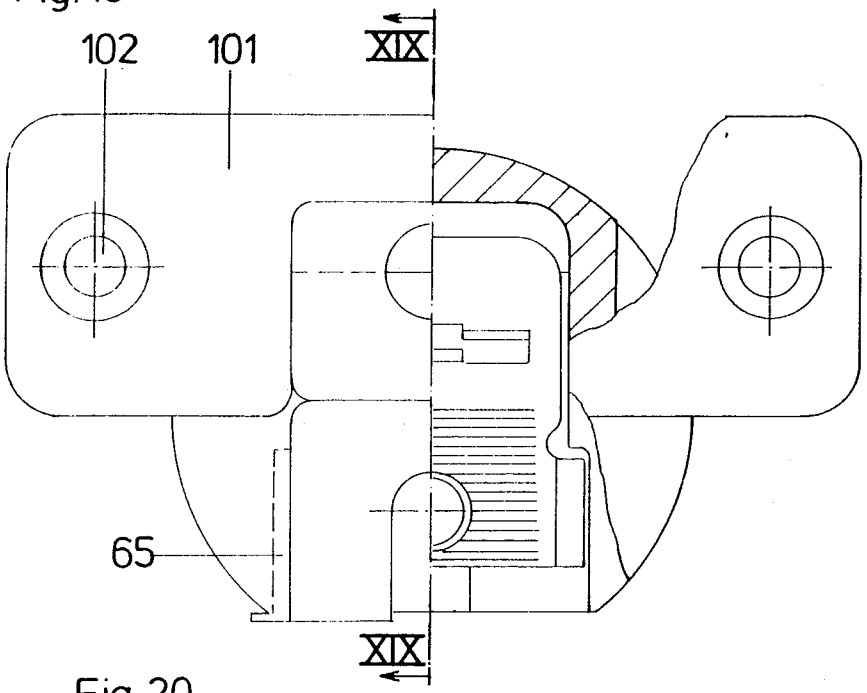
Figure 20:
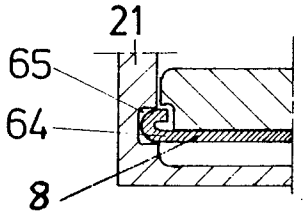
Figure 21:
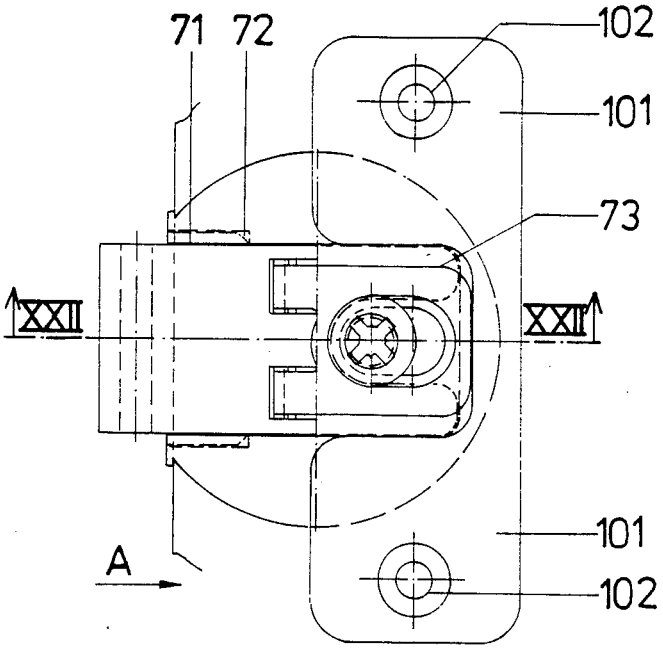
Figure 22:
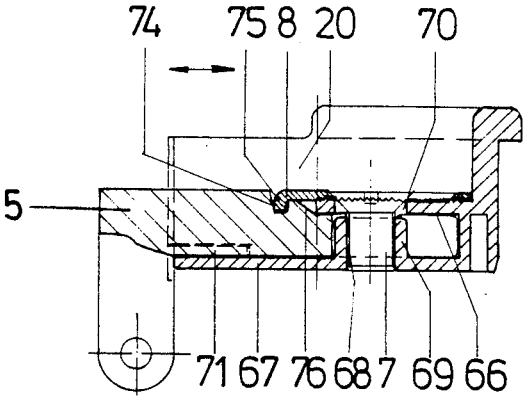
Figure 23:
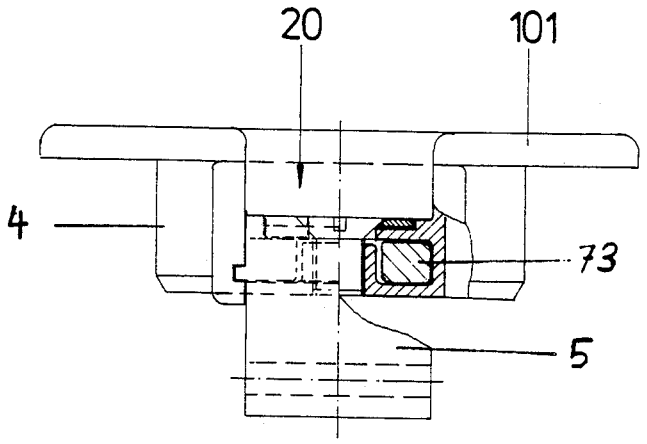
Figure 25:
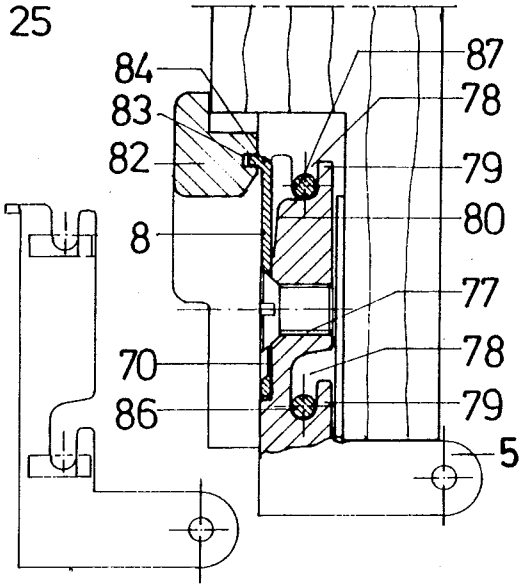
Figure 24:
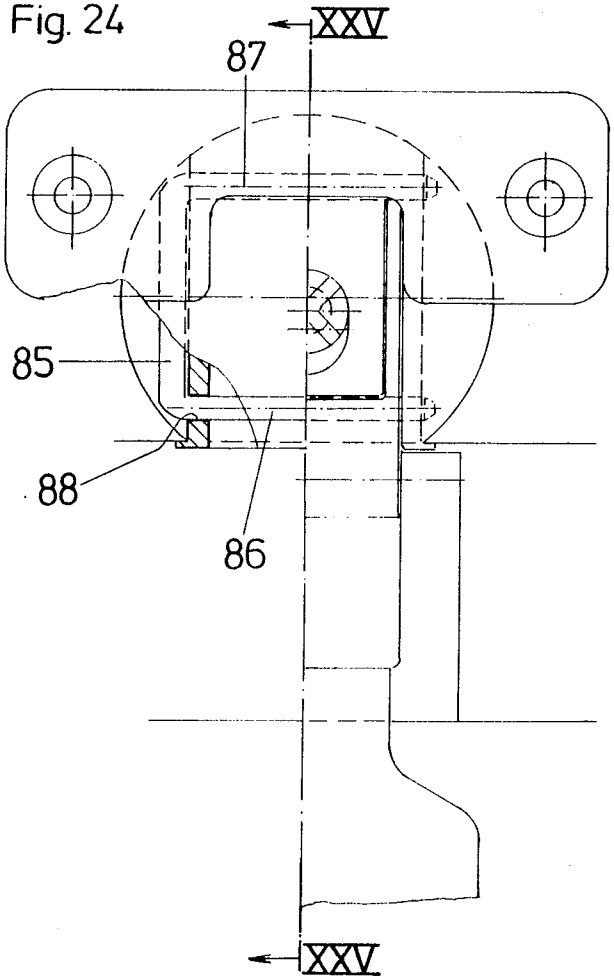
Figure 26:
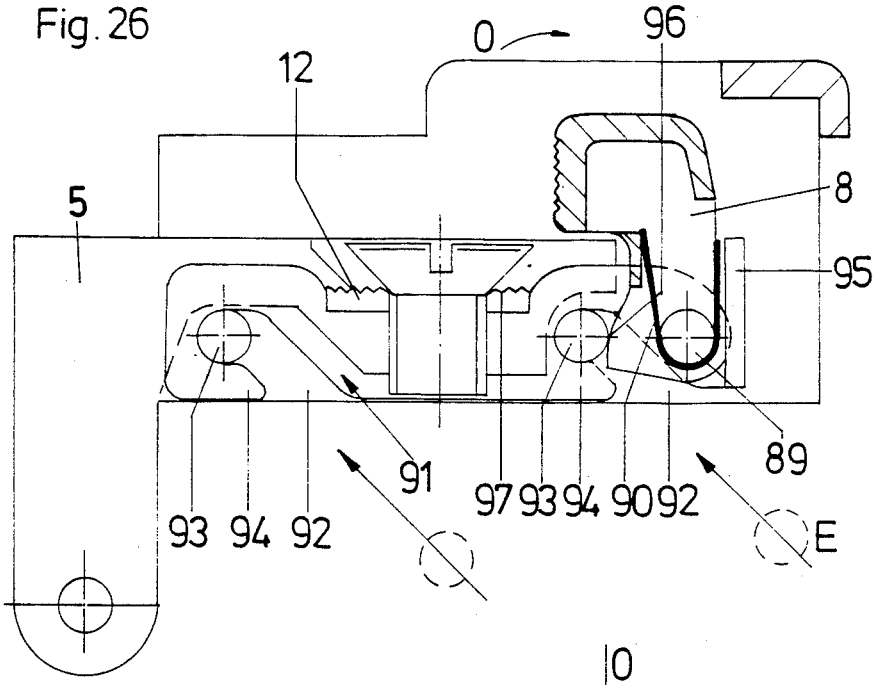
Figure 27:
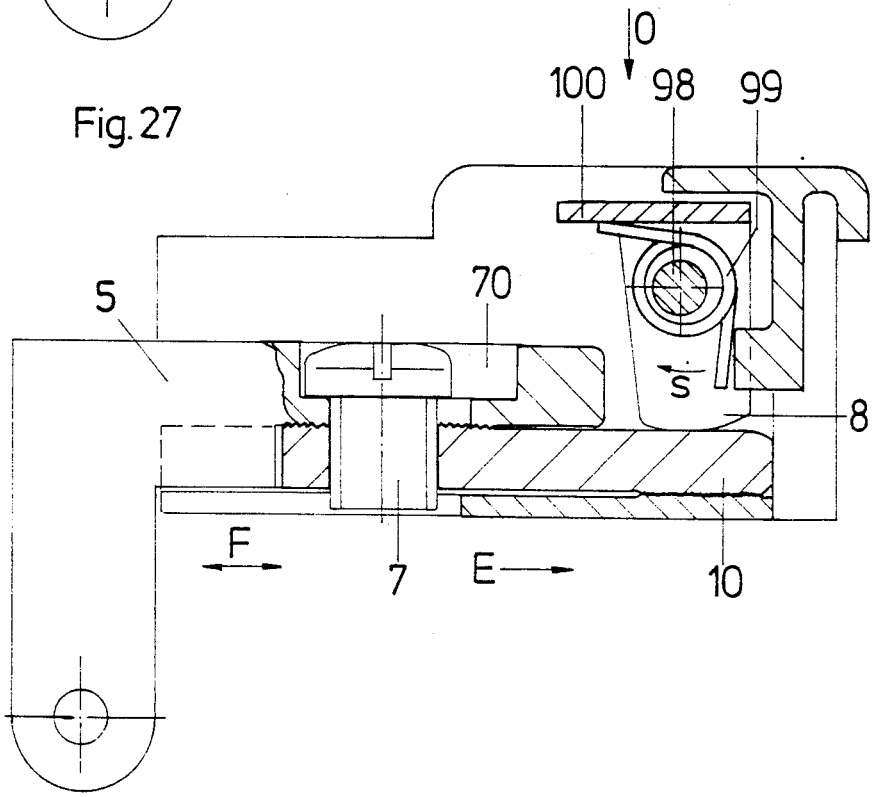

FIG. **14*a* is an enlarged section of a portion of the arrangement of FIG. 14**;

FIG. 15 is a sectional view along line XV—XV of FIG. 14;

FIG. 16 is a top view of a further embodiment of a hinge casing, parts thereof being shown in section;

FIG. 17 is a sectional view along line XVII—XVII of FIG. 16;

FIG. 18 is a top view of a further embodiment of the hinge casing, parts thereof being shown in section;

FIG. 19 is a sectional view along line XIX—XIX of FIG. 18;

FIG. 20 is a partial sectional view through a part of FIG. 18;

FIG. 21 is a top view of a hinge casing according to a further embodiment of the invention;

FIG. 22 is a sectional view along line XXII—XXII of FIG. 21;

FIG. 23 is a view from the direction of arrow A of FIG. 21, parts thereof being shown in section;

FIG. 24 is a top view of a further embodiment of a hinge casing according to the invention;

FIG. 25 is a sectional view along line XXV—XXV of FIG. 24, a coupling member thereof being additionally shown in the position before being engaged in the hinge casing;

FIG. 26 is a sectional view vertical to a hinge axle through a further embodiment of a hinge casing according to the invention; and FIG. 27 is a sectional view analogous to FIG. 26 but of a further embodiment of the hinge casing according to the invention.

FIGS. 5 to 27 do not illustrate the hinge parts and the hinge arms since they are not directly related to the present invention and may be made according to the known state of the art.

DETAILED DESCRIPTION OF THE INVENTION

FIGS. 1 to 4 show schematically various mounting possibilities of the hinge according to the invention, the term mounting meaning in this instance and in the following description engaging a door 3, i.e. connecting a hinge casing 4 with a coupling member 5. The basic structure used is a hinge arm 2 which is premounted at a furniture wall 1 and a hinge casing 4 which is inserted into the door 3. The coupling member 5 is connected with the hinge arm 2 by means of a hinge axle 6.

Figure 1:
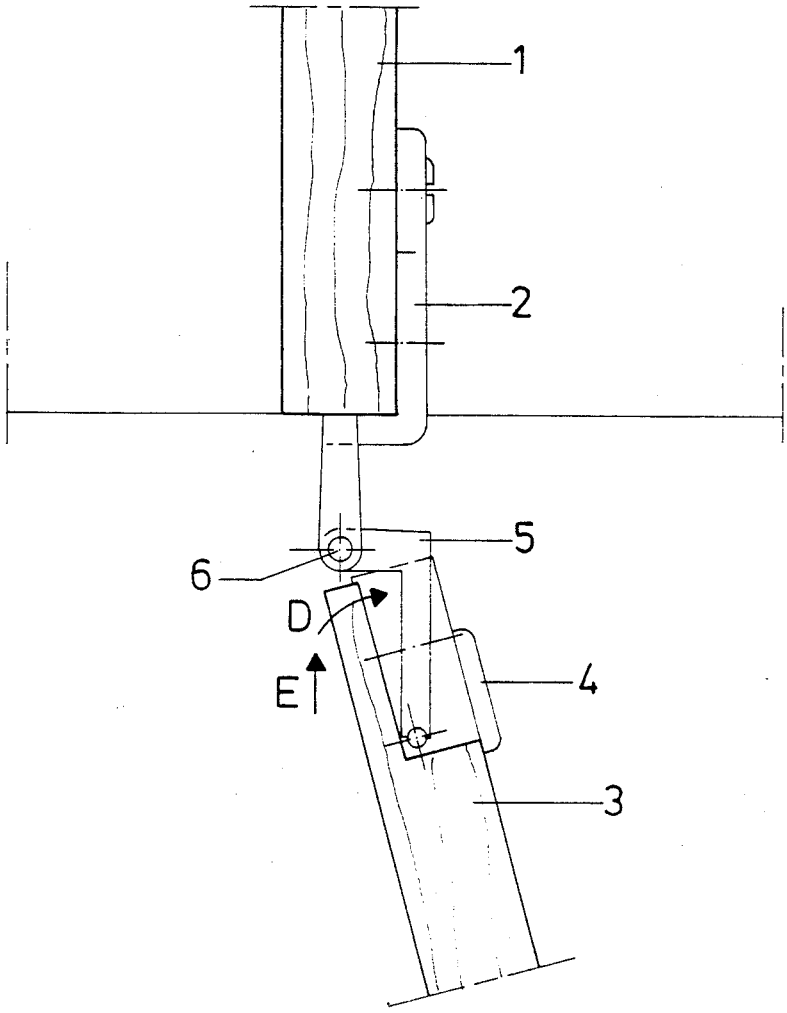
FIGS. 1 to 4 are horizontal sectional views of a door and a furniture wall and illustrating schematically different kinds of mounting of a hinge.

As shown in FIG. 1, the coupling member 5 is in an open position, and the door 3 is pushed onto the coupling member 5 in the direction of arrow E and then turned in the direction of arrow D, thus engaging the coupling member 5 in the hinge casing 4.

Figure 2:
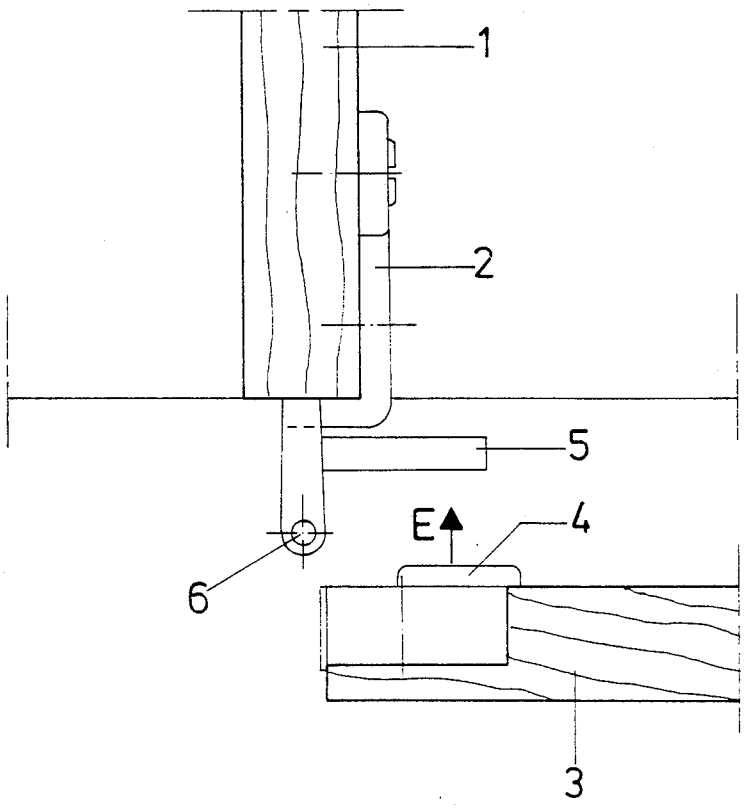

According to the embodiment shown in FIG. 2, the coupling member 5 is in a closed position, and the door 3 with the premounted hinge casing 4 is aligned parallel to a closing plane of the door and is pressed onto the coupling member 5.

Figure 3:
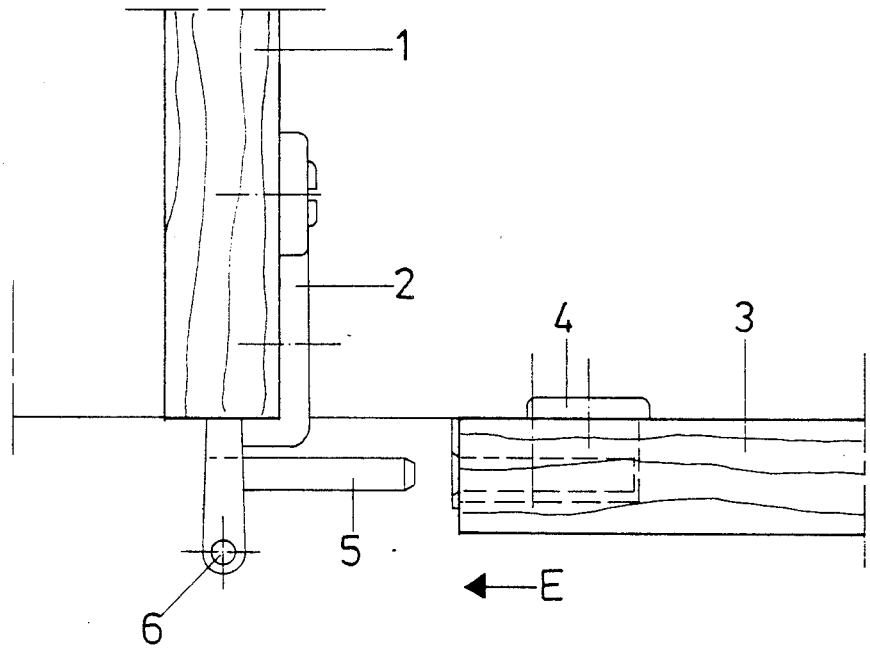
Figure 4:
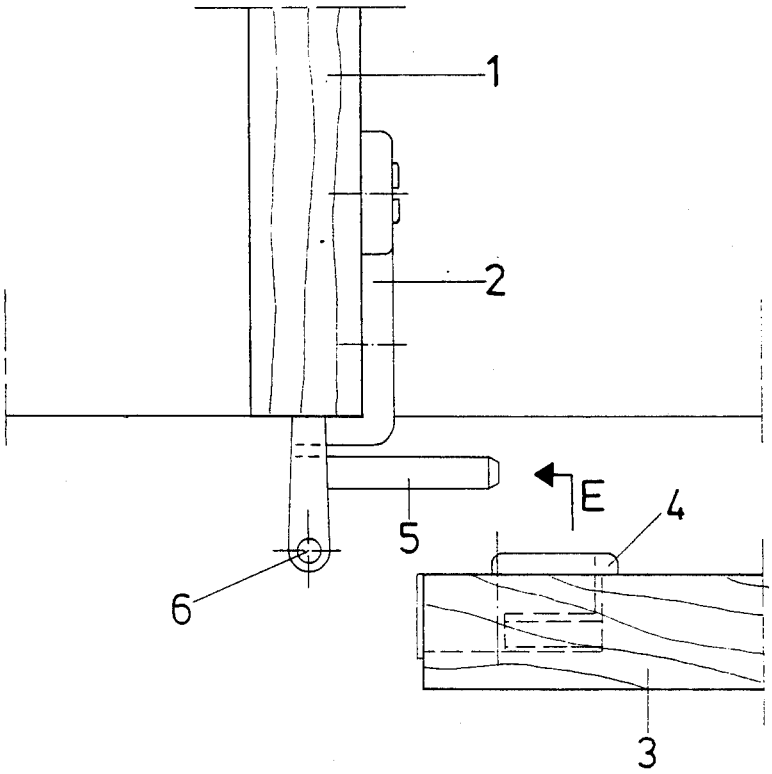

According to FIG. 3, the coupling member 5 is also in the closed position as is the door 3. The door 3 is pushed onto the coupling member 5 in the direction of arrow E. According to FIG. 4, the coupling member 5 is in the closed position, and the door 3 with the premounted hinge casing 4 is moved in a direction parallel to the closing plane and then in the direction of arrow E is pushed towards the closing plane and when in the closing plane is pushed onto the coupling member 5.

Description of specific embodiments of the invention now will be made.

Figure 5:
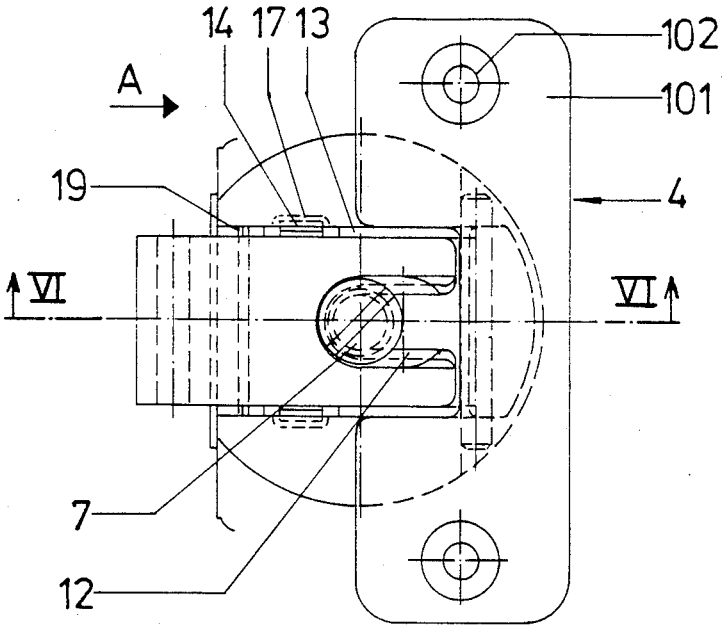
FIG. 5 is a top view of a hinge casing with a coupling member according to the invention.
Figure 6:
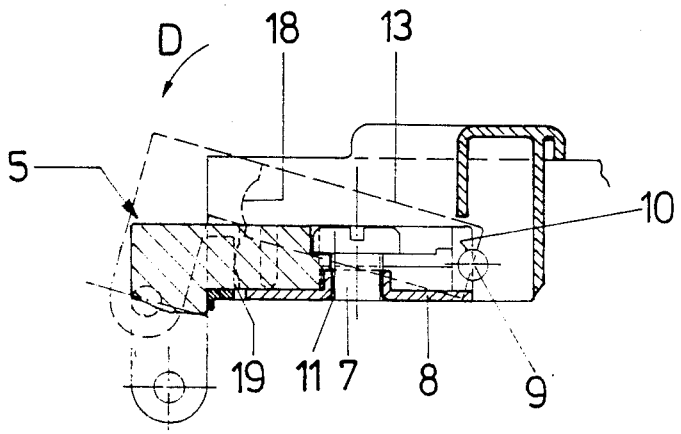
FIG. 6 is a sectional view along line VI—VI of FIG. 5.
Figure 7:
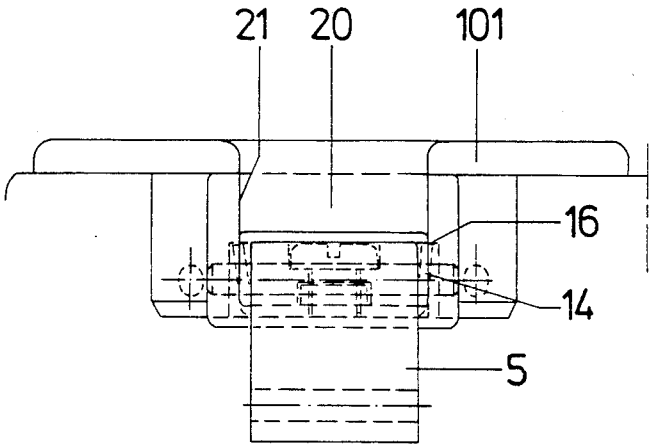
FIG. 7 is a view from the direction of arrow A of FIG. 5.

In the embodiment according to FIGS. 5 to 7, coupling member 5 is connected with a locking member 8 by means of a clamping screw 7. Locking member 8 has a U-shaped cross-section and lateral flanges 13. The clamping screw 7 is mounted in a female thread 11 of the locking member 8.

The ends of lateral flanges 13 remote from the hinge axle 6 are provided with notches 10. As can be seen from FIG. 6, the lateral flanges are, by means of notches 10, engaged with a pin 9 which is mounted in the hinge casing 4.

Then the coupling member 5 is turned in the direction of arrow D of FIG. 6, thus being moved from the position shown in broken lines into the position shown in continuous lines. This movement is a relative movement since, in reality, the door 3 is pivoted with the hinge casing 4 until the locking member 8 and the bottom of the hinge casing 4 lie parallel to each other and in one plane.

Hence, the coupling member 5 with the locking member 8 is fittable into a three-sided recess 20 of the hinge casing 4.

Flaps 14 which are punched from the lateral flanges 13 project into recesses 17 in the side walls 21 of the hinge casing 4 and abut on counter faces 16 of the hinge casing 4, when the coupling member 5 is in the locked position. At the ends opposite the pin 9, the side flanges 13 have bulges or protrusions 18 which abut on a counter surface 19 of the hinge casing 4, when the coupling member 5 is locked, so that the locking member 8 is locked with the coupling member 5 in the hinge casing 4 without clearance.

The clamping screw 7 projects through a slot 12 of the coupling member 5 so that an adjustment of the hinge casing 4 in the direction of the joint of the furniture door is possible. When the clamping screw 7 is loosened, the hinge casing 4 can be positioned over the length of the slot 12 at a greater or smaller distance from the hinge axle 6. The slot 12 is open at its rear end so that the door 3 with the hinge casing 4 easily can be removed again from the coupling member 5. Loosening of the clamping screw 7 will be sufficient.

In the embodiment according to FIGS. 8 to 10, pin 9 again is mounted in the hinge casing 4. The clamping screw 7 not only holds the locking member 8 to the coupling member 5, but it also holds a holding member 22. The holding member 22 has at a free end thereof a notch 23 by means of which the holding member is pushable onto the pin 9. On each of the coupling member 5 and the holding member 22 there are provided teeth or serrations 24 which improve a firm fit between such two members. The clamping screw 7 projects through an open slot 12 so that the coupling member 5 can easily be lifted from the hinge casing 4 after mounting.

Figure 10:
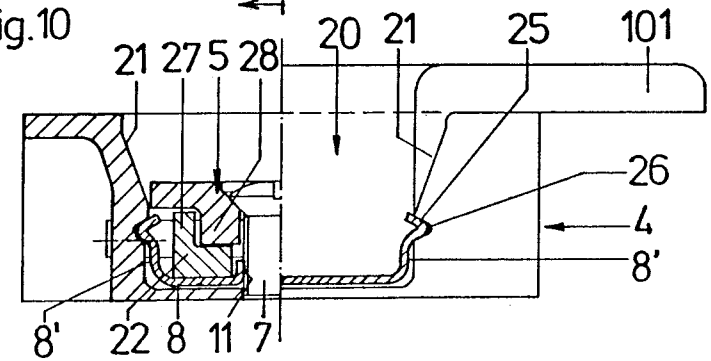
FIG. 10 is a sectional view along line X—X of FIG. 8.

The locking member 8, which is a leaf spring, has, as can be seen from FIG. 10, a U-shaped cross-section, and free ends of lateral flanges 8' thereof are provided with angular portions 25 which engage in notches 26 of the hinge casing 4.

Figure 9:
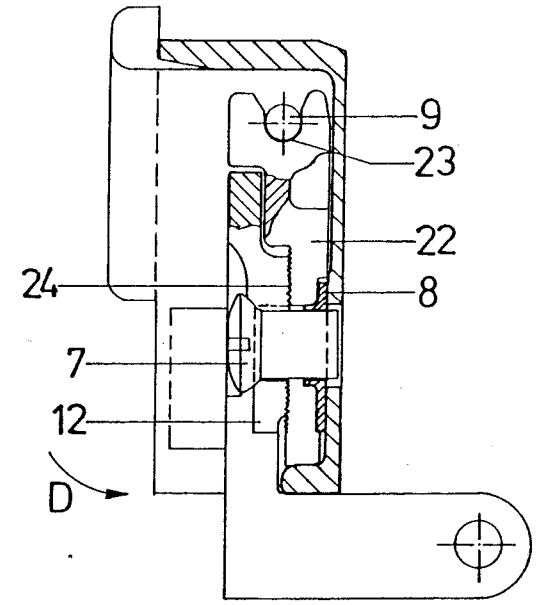
FIG. 9 is a sectional view along line IX—IX of FIG. 8.
Figure 8:
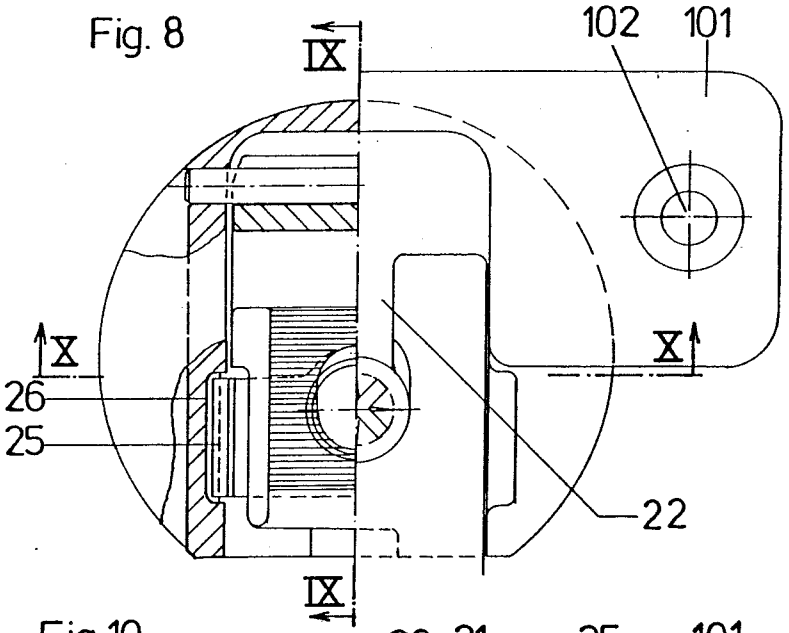
FIG. 8 is a top view of a further embodiment of a hinge casing, parts thereof being shown in section.

Side walls 21 of hinge casing 4 diverge above the notches 26 so that the coupling member 5 with the holding member 22 and the locking member 8 can easily be pressed in the direction of arrow D of FIG. 9 into the hinge casing 4. To improve the connection between the coupling member 5 and the holding member 22, the holding member 22 has a U-shaped cross section and is provided with lateral flanges 27 which embrace a base portion or member 28 of the coupling member 5. The clamping screw 7 is mounted in a female thread 11 of the locking member 8.

Figure 11:
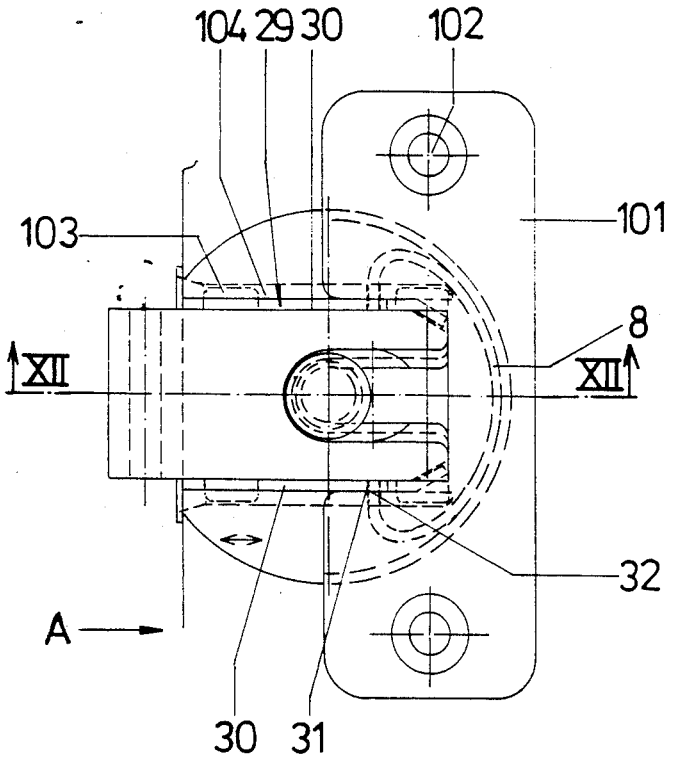
FIG. 11 is a top view of a further embodiment of a hinge casing.
Figure 12:
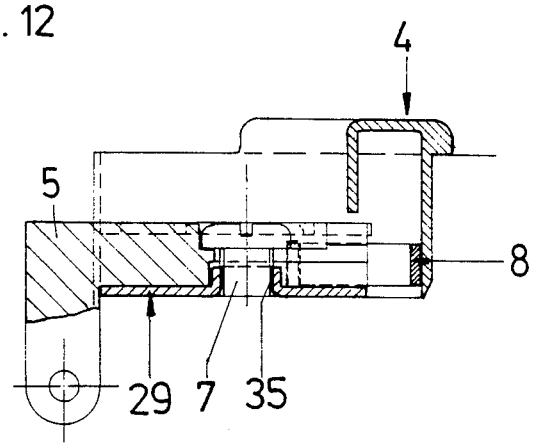
FIG. 12 is a sectional view along line XII—XII of FIG. 11.
Figure 13:
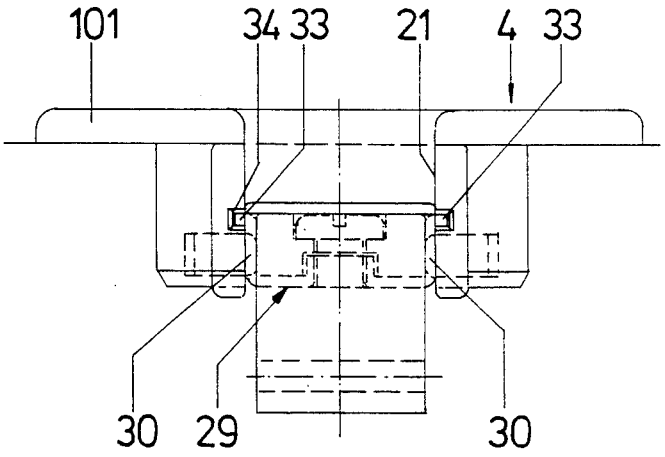
FIG. 13 is a view from the direction of arrow A of FIG. 11.

In the embodiment according to FIGS. 11 to 13, the locking member 8 is a C-shaped leaf spring which is mounted in the hinge casing 4. The coupling member 5 is, by means of the clamping screw 7, connected with a holding member 29 which has a U-shaped cross-section and is provided with lateral flange 30. The lateral flanges 30 have slots 31 in which free ends 32 of the locking member 8 engage when the hinge casing 4 is in the mounted position. Thus, the coupling member 5 together with the holding member 29 is locked in the hinge casing 4 in the direction of the double arrow of FIG. 11.

As can particularly be seen from FIG. 13, the holding member 29 has extending from lateral flanges 30 outward flanges or projections 33 which are fittable into grooves 34 of the side walls of the hinge casing 4. Hence, the coupling member 5 cannot be pivoted from the hinge casing 4 as long as it is held at the holding member 29 by means of the clamping screw 7. The clamping screw 7 is mounted in a female thread 35 of the holding member 29.

For mounting, the hinge casing 4 is, as can be seen from FIG. 13, pushed onto the coupling member 5 which carries the holding member 29. The free ends 32 of the locking member 8, which is a leaf spring, engage in the slots 31 of the holding member 29 when the coupling member 5 and the hinge casing 4 are in the position shown in FIG. 11.

In the embodiment according to FIGS. 14 and 15, the locking member 8 is a pivot lever which is mounted on the hinge casing 4 by an axle 36. The pivot lever or locking member 8 is acted upon by a pressure spring 37.

The clamping screw 7 holds a holding member 38 to the coupling member, clamping screw 7 being threaded into a female thread 39 of the holding member 38. Teeth or serrations 24 also are provided to improve the firm fit between the coupling member 5 and the holding member 38. The holding member 38 has flanges 40 which are insertable into grooves 41 of the hinge casing 4, as shown in FIGS. 14 and 14*a*.

Mounting or coupling of the hinge casing 4 to the coupling member 5 is effected by pushing the coupling member 5 from the front into the hinge casing 4.

The holding member 38 has a recess 42 into which a projection or nose 43 of the locking member 8 engages. Thus, the hinge casing 4 and the coupling member 5 with the holding member 38 are connectable with one another simply by being pushed toward one another.

The clamping screw 7 projects through a slot 70 in the coupling member 5.

In the embodiment according to FIGS. 16 to 17, the locking member 8 is a slide member which is acted upon by a pressure spring 44. The pressure spring 44 is positioned in a supplemental recess 45 of the hinge casing 4 which is open towards the recess 20 and presses on a flange 46 of the slide or locking member 8. The locking member 8 is U-shaped, when viewed from the top.

The clamping screw 7 projects through an open slot 12 of the coupling member 5 and is screwed into a thread 47 of a holding member 48. The holding member 48 has lateral flanges 49 which embrace the coupling member 5, pins or bolts 50 being formed on such lateral flanges on one or on both sides of the coupling member.

The locking member 8 has also lateral flanges or legs 51 which extend parallel to the flanges 49 and abut thereon. The flanges 51 are provided with slots 52 which form hook-like projections 53.

Grooves 54 are provided in the side walls 21 of the recess 20 of the hinge casing 4, grooves 54 being open towards a flange 55 of the hinge casing 4 and the walls 56 thereof diverging at the edge 57 of the recess 20. For mounting, the holding member 48 is held at the coupling member 5 by means of the clamping screw 7, and such two members together are fitted into the recess 20.

The bolts 50 project into the grooves 54 so that an exact guiding of the coupling member 5 and of the holding member 48 is obtained. The locking member 8, which is a slide, can be pushed back in the direction of arrow A of FIG. 16, for example by pushing on a center flange 8" thereof. Thus, the hook-like projections 53 clear the grooves 54 and the passage for the bolts 50. When the coupling member 5 and the holding member 48 are in the desired position at the bottom of the hinge casing 4, the locking member 8 is released and by the spring 44 is brought into the locking position shown in FIG. 16.

Release of the coupling member 5 from the hinge casing 1 can be effected either by pushing back the locking member 8 or by loosening the clamping screw 7.

In the embodiment according to FIGS. 18 to 20, the locking member 8 is a leaf spring screwed to the coupling member 5 by means of the clamping screw 7. The clamping screw 7 projects through a slot 70 in the coupling member 5. The hinge casing 4 has a bottom 58 and a projecting horizontal flange or plate-like portion 59. The horizontal flange 59 is provided with an opening 60 through which a tool, for example a screwdriver 61, can be guided.

In the mounted position, the locking member 8 extends below the opening 60, as can be seen from FIG. 19.

A recess or notch 62 is arranged in the horizontal flange 59 into which punched flanges 63 of the locking member 8 project in such a manner that they snugly engage in the recess 62 and that the locking member 8 is thus locked from movement in the direction of the double arrow of FIG. 19.

Lateral edges 64 of the locking member are bent and project into grooves 65 of side walls 21 of the hinge casing. The coupling member 5 can be fitted into the hinge casing 4 from the front, the holding member 8 being guided in the grooves 65. As soon as the flanges 63 engage in the recess 62, the coupling member 5 is locked in the hinge casing 4.

The coupling member 5 is released from the hinge casing 4 either by pressing the holding member 8 out from the recess 62 by means of the screw driver 61, or by unscrewing the clamping screw 7 from female thread 11 in the locking member.

In the embodiment according to FIGS. 21 to 23, the locking member 8 again is a leaf spring but is held on a horizontal flange 66 of the hinge casing 4 by means of the clamping screw 7. The horizontal flange 66 extends parallel to a bottom 67 of the hinge casing, and the clamping screw 7 is mounted in a thread 68 in a base member 69 which projects from the bottom 67 of the hinge casing.

The hinge casing has, in this embodiment also, a recess 20 which is surrounded on three sides and in which the horizontal flange 66 and the holding member 8 are arranged.

The locking member 8 is provided with a slot 70 through which the clamping screw 7 projects. The slot 70 serves for the adjustment of the joint of the hinge. The leaf spring which serves as locking member 8 can be displaced along slot 70 relative to the horizontal flange 66. The coupling member 5 has lateral flanges or projections 71 which are fittable into grooves 72 of the hinge casing which extend parallel to the bottom 67. The coupling member 5 is forked at its end and extends with two fingers or legs 73 into chambers of the hinge casing which are covered by the horizontal flange 66. In the mounted position, the clamping screw 7 is positioned between the two fingers 73.

The coupling member 5 is further provided with a notch 74 into which a bent end or protrusion 75 of the locking member 8 engages in the mounted position. This engaging arrangement is facilitated by an inclined surface 76 of member 5 arranged in the inserting direction before the notch 75.

For mounting, the flanges 71 of coupling member 5 are pushed into the grooves 72, and the fingers 73 are pushed into the chambers of the hinge casing 4 until the edge 75 of the locking member 8 engages in the notch 74.

Adjustment of the joint can be effected by loosening the clamping screw 7 and by displacing the coupling member 5 with the locking member 8 in the direction of the double arrow of FIG. 22 over the length of the slot 70. For releasing the connection between the coupling member 5 and the hinge casing 4, the clamping screw 7 is loosened to such an extent that the edge 75 of the locking member disengages from the notch 74.

In the embodiment according to FIGS. 24 and 25, the locking member 8 again is a leaf spring but is directly held at the coupling member 5 by means of the clamping screw 7. The clamping screw 7 projects through a slot 70 in the locking member 8 and is mounted in a female thread 77 in the coupling member 5. The coupling member 5 is provided with slots 78 which form snap-in projections 79. One of slots 78 is forwardly open, and a second of slots 78 is L-shaped.

On the outer surface of the coupling member 5 next to the locking member 8, there is an inclined surface 80 which forms a recess in the coupling member 5.

The hinge casing 4 has a projecting block 82 with a groove 83 being formed on its lower side.

A free edge of the locking member 8 has an angled edge portion 84 which is directed towards the groove 83. A U-shaped lever 85 is laterally fitted into the hinge casing 4, the side legs of lever 85 forming holding pins 86, 87 which project through openings 88 in the hinge casing 4.

For a mounting operation, the lever 85 is in the hinge casing 4, and the leaf spring which forms the locking member 8 is connected to the coupling member 5. The coupling member 5 is fitted into the hinge casing 4 in such a manner that the holding pins 86, 87 fit within slots 78. When the edge portion 84 engages in the groove 83, the coupling member 5 and the hinge casing 4 are connected. The relative course of motion of coupling member 5 and hinge casing 4 runs first in a direction vertically to the door 3 and then in the plane of the door 3.

In the embodiment according to FIG. 26, the locking member 8 is a pivot lever mounted on an axle 89. The pivot lever or locking member 8 is acted upon by a torsion or leg spring 90 which abuts inside the hinge casing 4. The clamping screw 7 connects the coupling member 5 with a holding member 91 which is provided with L-shaped slots 92 with beveled ends.

Holding pins 93 which are aligned parallel to the hinge axle are mounted in the hinge casing 4. For a mounting operation, the hinge casing 4 is moved with respect to the coupling member 5 in the direction of arrows E so that the holding pins 93 can first be guided through the beveled portions of slots 92 until they engage behind projections 94 of the holding member 91, as shown in FIG. 26.

The holding member 91 is preferably U-shaped, when viewed from the top, and comprises a center flange 95 which connects two external lateral parts. The axle 89 and thus the locking member 8 are mounted at the holding member 91 near the center flange 95. When the holding pins 93 are in the position shown in FIG. 26, the locking member 8 can engage with a holding nose or protrusion 96 thereof behind the forward or inner holding pin 93, the coupling member 5 and the hinge casing 4 thus being coupled. If the connection is to be released, the locking member 8 must be pressed back against the pressure of the spring 90 in the direction of arrow O.

The clamping screw 7 projects through a slot 12 in the coupling member 5. To improve the connection between the coupling member 5 and the holding member 91, a teeth or serrations 97 therebetween are provided.

In the embodiment according to FIG. 27, the locking member 8, which is a pivot lever, is mounted on an axle 98 in the hinge casing 4. A holding member 10 is screwed to the coupling member 5 by means of the clamping screw 7. The clamping screw 7 projects through a slot 70 in the coupling member 5. The holding member 8 has lateral flanges which are fittable, analogously to the flanges 71 of FIG. 21, into corresponding grooves in the side walls of the hinge casing 4.

A leg or torsion spring 99 presses the locking member 8 in the direction of arrow S into a locking position. When the holding member 10 with the coupling member 5 is pushed in the direction of arrow E into the hinge casing 4, it comes to lie below the locking member 8, which is a pivot lever, and is held by frictional force which is exerted by the locking member 8 due to spring 99.

To release the connection between the holding member 10 and the hinge casing 4, which means also to release the connection between the coupling member 5 and the hinge casing 4, it is sufficient to press on a lever arm 100 of the locking member 8 in the direction of arrow O.

The adjustment of the joint is effected by releasing the clamping screw 7 and displacing the coupling member 5 along the holding member 10 in the directions of double arrow F.

In all embodiments, the coupling member 5 is L-shaped and configured as a one-axle lever. The hinge casing 4 is provided with a flange 101 which has holes 102 adapted to receive fastening screws to connect the hinge casing to the door.

What is claimed is:

1. A hinge for enabling a furniture door to be releasably mounted to a furniture wall, said hinge comprising:
   - a hinge casing to be mounted on the furniture door, said hinge casing having extending thereacross a pin;
   - a hinge arm to be mounted on the furniture wall;
   - a coupling member pivotally connected to said hinge arm and selectively insertable into said hinge casing to a coupled position and removable therefrom, thereby coupling said hinge casing and the furniture door to the hinge arm and the furniture wall; and
   - locking means coupled to said coupling member by a clamping screw, for releasably locking said coupling member in said coupled position in said hinge casing, said locking means comprising a member having a U-shaped configuration including two lateral flanges between which is positioned said coupling member, and inner ends of said flanges having notches engaging said pin such that said hinge casing is pivotable about said pin relative to said locking means and said coupling member to said coupled position.

2. A hinge as claimed in claim 1, wherein said clamping screw extends through a slot in said coupling member and is threaded into said locking means, such that the relative position between said coupling member and said locking means is adjustable over the length of said slot upon loosening of said clamping screw.

3. A hinge as claimed in claim 1, wherein outer ends of said flanges abut countersurfaces of said hinge casing in said coupled position.

4. A hinge as claimed in claim 1, wherein said flanges have laterally outwardly extending flaps that fit into lateral recesses in said hinge casing when said coupling member and said locking means are in said coupled position.

5. A hinge as claimed in claim 1, wherein said coupling member has an L-shaped configuration.

6. A hinge as claimed in claim 1, wherein said coupling member is fittable into a three-sided recess in said hinge casing.

7. A hinge for enabling a furniture door to be releasably mounted to a furniture wall, said hinge comprising:
a hinge casing to be mounted on the furniture door;
a hinge arm to be mounted on the furniture wall;
a coupling member pivotally connected to said hinge arm and selectively insertable into said hinge casing to a coupled position and removable therefrom, thereby coupling said hinge casing and the furniture door to the hinge arm and the furniture wall;
locking means coupled to said coupling member by a clamping screw, for releasably locking said coupling member in said coupled position in said hinge casing, said clamping screw extending through a slot in said coupling member and through an opening in a holding member and being threaded into said locking means, whereby upon tightening said clamping screw said locking means and said coupling member are clamped toward each other with said holding member therebetween, and whereby upon loosening said clamping screw the position of said coupling member relative to said holding member and said locking means is adjustable over the length of said slot; and
confronting surfaces of said coupling member and said holding member being serrated.

8. A hinge for enabling a furniture door to be releasably mounted to a furniture wall, said hinge comprising:
a hinge casing to be mounted on the furniture door, said hinge casing having extending thereacross a pin;
a hinge arm to be mounted on the furniture wall;
a coupling member pivotally connected to said hinge arm and selectively insertable into said hinge casing to a coupled position and removable therefrom, thereby coupling said hinge casing and the furniture door to the hinge arm and the furniture wall;
locking means coupled to said coupling member by a clamping screw, for releasably locking said coupling member in said coupled position in said hinge casing, said clamping screw extending through a slot in said coupling member and through an opening in a holding member and being threaded into said locking means, whereby upon tightening said clamping screw said locking means and said coupling member are clamped toward each other with said holding member therebetween, and whereby upon loosening said clamping screw the position of said coupling member relative to said holding member and said locking means is adjustable over the length of said slot; and
an inner end of said holding member having a notch engaging said pin such that said hinge casing is pivotable about said pin relative to said welding member, said locking means and said coupling member to said coupled position.

9. A hinge as claimed in claim 8, wherein said locking means comprises a leaf spring having a U-shaped configuration including portions engaging in recesses in said hinge casing in said coupled position.

10. A hinge as claimed in claim 9, wherein said U-shaped leaf spring has two lateral flanges between which is positioned said holding member.

11. A hinge as claimed in claim 10, wherein said portions of said leaf spring comprise angular projections extending laterally outwardly from said flanges.

12. A hinge as claimed in claim 9, wherein walls of said hinge casing diverge outwardly and upwardly above said recesses.

13. A hinge for enabling a furniture door to be releasably mounted to a furniture wall, said hinge comprising:
a hinge casing to be mounted on the furniture door;
a hinge arm to be mounted on the furniture wall;
a coupling member pivotally connected to said hinge arm and selectively insertable into said hinge casing to a coupled position and removable therefrom, thereby coupling said hinge casing and the furniture door to the hinge arm and the furniture wall;
a holding member coupled to said coupling member by a clamping screw; and
locking means, comprising a leaf spring mounted on said hinge casing and engaging said holding member, for releasably locking said coupling member in said coupled position in said hinge casing.

14. A hinge as claimed in claim 13, wherein said holding member has a U-shaped configuration including two lateral flanges with said coupling member positioned therebetween, said flanges have notches, and said leaf spring has a C-shaped configuration with opposite ends fitting into said notches.

15. A hinge as claimed in claim 14, wherein said flanges have extending laterally outwardly therefrom longitudinal projections fitting into longitudinal recesses in said hinge casing, whereby said hinge casing is movable longitudinally of said holding member and said coupling member with said longitudinal projections being slidably received in said longitudinal recesses until said opposite ends of said leaf spring snap into said notches in said flanges of said holding member at said coupled position.

16. A hinge as claimed in claim 13, wherein said clamping screw extends through a slot in said coupling member and is threaded into said holding member, whereby the relative position between said coupling member and said holding member is adjustable over the length of said slot upon loosening said clamping screw.

17. A hinge for enabling a furniture door to be releasably mounted to a furniture wall, said hinge comprising:
a hinge casing to be mounted on the furniture door;
a hinge arm to be mounted on the furniture wall;
a coupling member pivotally connected to said hinge arm and selectively insertable into said hinge casing to a coupled position and removable therefrom, thereby coupling said hinge casing and the furniture door to the hinge arm and the furniture wall;
a holding member coupled to said coupling member by a clamping screw; and
locking means, comprising a locking member pivoted to said hinge casing and engageable with said holding member, for releasably locking said coupling member in said coupled position in said hinge casing.

18. A hinge as claimed in claim 17, wherein said locking member includes a protrusion fittable into a recess in said holding member, and further comprising spring means urging said locking member to pivot relative to said hinge casing to a position for said protrusion to engage in said recess.

19. A hinge as claimed in claim 18, wherein said holding member has extending laterally therefrom longitudinal projections fitting into longitudinal recess in said hinge casing, whereby said hinge casing is movable longitudinally of said holding member and said coupling member with said longitudinal projections being slidably received in said longitudinal recesses until said protrusion snaps into said recess at said coupled position.

20. A hinge as claimed in claim 17, wherein said clamping screw extends through a slot in said coupling member and is threaded into said holding member, whereby the relative position between said coupling member and said holding member is adjustable over the length of said slot upon loosening said clamping screw.

21. A hinge for enabling a furniture door to be releasably mounted to a furniture wall, said hinge comprising:

a hinge casing to be mounted on the furniture door;

a hinge arm to be mounted on the furniture wall;

a coupling member pivotally connected to said hinge arm and selectively insertable into said hinge casing to a coupled position and removable therefrom, thereby coupling said hinge casing and the furniture door to the hinge arm and the furniture wall;

a holding member coupled to said coupling member by a clamping screw; and locking means, comprising a slide member mounted on said hinge casing and movable relative thereto between a locking position retaining said coupling member and said holding member in said coupled position and an unlocking position releasing said coupling member and said holding member from said coupled position, for releasably locking said coupling member in said coupled position in said hinge casing.

22. A hinge as claimed in claim 21, further comprising spring means urging said slide member toward said locking position.

23. A hinge as claimed in claim 22, wherein said holding member has a U-shaped configuration including two lateral flanges with said coupling member positioned therebetween, and pins extending laterally outwardly from said flanges.

24. A hinge as claimed in claim 23, wherein said slide member has a U-shaped configuration including two lateral longitudinal legs abutting respective said flanges, said legs having slots defining hooks, said pins extending through said slots, and said hooks hooking over said pins when said slide member is in said locking position, thereby retaining said holding member and said coupling member in said coupled position.

25. A hinge as claimed in claim 24, wherein said hinge casing has lateral grooves open at ends thereof adjacent an upper edge of said hinge casing, said pins being slidably receivable in said grooves.

26. A hinge as claimed in claim 25, wherein said grooves diverge upwardly.

27. A hinge as claimed in claim 24, wherein said U-shaped slide member includes a center leg having a greater height than said longitudinal legs.

28. A hinge as claimed in claim 22, wherein said spring means comprises a coil spring mounted in a lateral recess within said hinge casing and acting on a lateral protrusion of said slide member.

29. A hinge as claimed in claim 21, wherein said clamping screw extends through a slot in said coupling member and is threaded into said holding member, whereby the relative position between said coupling member and said holding member is adjustable over the length of said slot upon loosening said clamping screw.

30. A hinge for enabling a furniture door to be releasably mounted to a furniture wall, said hinge comprising:

a hinge casing to be mounted on the furniture door;

a hinge arm to be mounted on the furniture wall;

a coupling member pivotally connected to said hinge arm and selectively insertable into said hinge casing to a coupled position and removable therefrom, thereby coupling said hinge casing and the furniture door to the hinge arm and the furniture wall; and locking means coupled to said coupling member by a clamping screw, for releasably locking said coupling member in said coupled position in said hinge casing, said locking means comprising a leaf spring having at least one protrusion that engages in a notch in said hinge casing.

31. A hinge as claimed in claim 30, wherein lateral longitudinal edges of said leaf spring are fittable into longitudinal recesses in said hinge casing, whereby said hinge casing is movable longitudinally of said leaf spring and said coupling member with said longitudinal edges being slidably received in said longitudinal recesses until said protrusion of said leaf spring snaps into said notch in said hinge casing at said coupled position.

32. A hinge as claimed in claim 30, wherein said notch is formed in a lower surface of a plate-like projection of said hinge casing, said plate-like projection having therethrough an opening to permit passage therethrough of a tool to bend said leaf spring such that said protrusion thereof can be withdrawn from said notch to enable said hinge casing to be removed longitudinally from said leaf spring and said coupling member.

33. A hinge as claimed in claim 30, wherein said clamping screw extends through a slot in said coupling member and is threaded into said leaf spring, such that the relative position between said coupling member and said leaf spring is adjustable over the length of said slot upon loosening of said clamping screw.

34. A hinge for enabling a furniture door to be releasably mounted to a furniture wall, said hinge comprising:

a hinge casing to be mounted on the furniture door;

a hinge arm to be mounted on the furniture wall;

a coupling member pivotally connected to said hinge arm and selectively insertable into said hinge casing to a coupled position and removable therefrom, thereby coupling said hinge casing and the furniture door to the hinge arm and the furniture wall; and locking means coupled to said hinge casing by a clamping screw, for releasably locking said coupling member in said coupled position in said hinge casing, said locking means comprising a leaf spring having at least one protrusion engaging in a notch in said coupled position.

35. A hinge as claimed in claim 34, wherein said coupling member has laterally extending longitudinal projections fittable into longitudinal recesses in said hinge casing, such that said hinge casing is movable longitudinally of said coupling member with said longitudinal projections being slidably received in said longitudinal recesses until said protrusion of said leaf spring snaps into said notch in said coupling member at said coupled position.

36. A hinge as claimed in claim 34, wherein said coupling member has a fork-like configuration including two longitudinal legs slidably extendable into chambers within said hinge casing, and said leaf spring covers said chambers.

37. A hinge as claimed in claim 34, wherein said clamping screw extends through a slot in said leaf spring and is threaded into said hinge casing, such that the relative position between said leaf spring and said hinge casing is adjustable over the length of said slot upon loosening of said clamping screw.

38. A hinge for enabling a furniture door to be releasably mounted to a furniture wall, said hinge comprising:
a hinge casing to be mounted on the furniture door;
a hinge arm to be mounted n the furniture wall;
a coupling member pivotally connected to said hinge arm and selectively insertable into aid hinge casing to a coupled position and removable therefrom, thereby coupling said hinge casing and the furniture door to the hinge arm and the furniture wall; and
locking means coupled to said coupling member by a clamping screw, for releasably locking said coupling member in said coupled position in said hinge casing, said locking means comprising a leaf spring having a protrusion engageable in a notch in said hinge casing.

39. A hinge as claimed in claim 38, wherein said hinge casing has pins extending thereacross, and said coupling member has therein slots fittable over said pins, such that said hinge casing is movable relative to said coupling member with said pins sliding into said slots until said protrusion of said leaf spring snaps into said notch in said hinge casing at said coupled position.

40. A hinge as claimed in claim 39, wherein said pins are legs of a U-shaped member and are insertable laterally through openings in said hinge casing.

41. A hinge as claimed in claim 38, wherein said coupling member has a recessed area into which is pressable that portion of said leaf spring including said protrusion to disengage said protrusion from said notch to enable removal of said hinge casing from said leaf spring and said coupling member.

42. A hinge as claimed in claim 38, wherein said clamping screw extends through a slot in said leaf spring and is threaded into said coupling member, such that the relative position between said leaf spring and said coupling member is adjustable over the length of said slot upon loosening said clamping screw.

43. A hinge for enabling a furniture door to be releasably mounted to a furniture wall, said hinge comprising:
a hinge casing to be mounted on the furniture door;
a hinge arm to be mounted on the furniture wall;
a coupling member pivotally connected to said hinge arm and selectively insertable into said hinge casing to a coupled position and removable therefrom, thereby coupling said hinge casing and the furniture door to the hinge arm and the furniture wall;
locking means, mounted on one of said hinge casing or said coupling member, for releasably locking said coupling member in said coupled position in said hinge casing;
a holding ;member coupled together with said coupling member by a clamping screw, said holding member having therein slots; and
pins extending across said hinge casing and received in said slots in said holding member.

44. A hinge as claimed in claim 43, wherein said locking means comprises a lever pivoted on said holding member and urged to a locking position whereat a portion thereof maintains one of said pins in the respective said slot in said coupled position.

45. A hinge as claimed in claim 44, further comprising spring means urging said lever toward said locking position.

46. A hinge as claimed in claim 43, wherein said clamping screw extends through a slot in said coupling member and is threaded into said holding member, whereby the relative position between said coupling member and said holding member is adjustable over the length of said slot upon loosening said clamping screw.

47. A hinge for enabling a furniture door to be releasably mounted to a furniture wall, said hinge comprising:
a hinge casing to be mounted on the furniture door;
a hinge arm to be mounted on the furniture wall;
a coupling member pivotally connected to said hinge arm and selectively insertable into said hinge casing to a coupled position and removable therefrom, thereby coupling said hinge casing and the furniture door to the hinge arm and the furniture wall;
a holding member coupled to said coupling member by a clamping screw; and
locking means, mounted on one of said hinge casing or said coupling member, for releasably locking said coupling member in said coupled position in said hinge casing, said locking means comprising a lever pivoted on said hinge casing and having an abutment surface, and spring means urging said lever to a locking position whereat said abutment surface frictionally engages an upper surface of said holding member and clamps said holding member against said hinge casing.

48. A hinge as claimed in claim 47, wherein said clamping screw extends through a slot in said coupling member and is threaded into said holding member, whereby the relative position between said coupling member and said holding member is adjustable over the length of said slot upon loosening said clamping screw.

* * * * *